US007168697B2

(12) United States Patent
Ratz

(10) Patent No.: US 7,168,697 B2
(45) Date of Patent: Jan. 30, 2007

(54) DEVICE FOR DELIVERING PRINTED PRODUCTS AND MACHINE AND METHOD FOR PROCESSING PRINTED PRODUCTS

(75) Inventor: Holger Ratz, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 307 days.

(21) Appl. No.: 10/508,003

(22) PCT Filed: Feb. 28, 2003

(86) PCT No.: PCT/DE03/00671

§ 371 (c)(1),
(2), (4) Date: Sep. 24, 2004

(87) PCT Pub. No.: WO03/080489

PCT Pub. Date: Oct. 2, 2003

(65) Prior Publication Data

US 2005/0104271 A1 May 19, 2005

(30) Foreign Application Priority Data

Mar. 26, 2002 (DE) ..... 102 13 461

(51) Int. Cl.
*B65H 29/04* (2006.01)

(52) U.S. Cl. ..... 271/69; 271/204; 271/82

(58) Field of Classification Search ..... 271/82, 271/315, 187, 204, 72, 69; 270/52.14, 52.16; 198/470.1, 469.1

See application file for complete search history.

(56) References Cited

U.S. PATENT DOCUMENTS

| | | | | |
|---|---|---|---|---|
| 5,611,530 | A * | 3/1997 | Maresse et al. | 271/315 |
| 6,168,152 | B1 * | 1/2001 | Ratz | 271/204 |
| 6,179,111 | B1 * | 1/2001 | Ratz | 198/370.05 |
| 7,048,110 | B2 * | 5/2006 | Hachiya et al. | 198/470.1 |

FOREIGN PATENT DOCUMENTS

| | | |
|---|---|---|
| DE | 196 42 118 A | 4/1998 |
| DE | 196 42 118 C | 4/1998 |
| DE | 196 42 130 C | 4/1998 |

* cited by examiner

*Primary Examiner*—Patrick Mackey
*Assistant Examiner*—Kaitlin Joerger
(74) *Attorney, Agent, or Firm*—JonesTullar&Cooper, PC

(57) ABSTRACT

A device that is usable for delivering printed products includes two bucket or paddle wheels that can rotate about two different axes of rotation. Each bucket or paddle wheel includes a plurality of scoop-type elements that can receive printed products from a first or a second product flow. A gripper chain is guided around the two different axes of rotation. Grippers are arranged on the gripper chain and can grip and printed products received in the scoop-type element to thereby remove the product from the scoop. At least one device that will open the grippers, for release of the printed products held by the grippers, is arranged along the path of travel of the gripper chain.

15 Claims, 3 Drawing Sheets

DEVICE FOR DELIVERING PRINTED PRODUCTS AND MACHINE AND METHOD FOR PROCESSING PRINTED PRODUCTS

CROSS-REFERENCE TO RELATED APPLICATIONS

This patent application is the U.S. National Phase, under 35 U.S.C. 371, of PCT/DE03/00671, filed Feb. 28, 2003; published as WO 03/080489 A2 and A3 on Oct. 2, 2003 and claiming priority to DE 102 13 461.8, filed Mar. 26, 2002, the disclosures of which are expressly incorporated herein by reference.

FIELD OF THE INVENTION

The present invention is directed to a device for delivering printed products, as well as to a method for processing printed products. At least two paddle wheels, which receive products from two product streams, have those products removed by a single gripper chain.

BACKGROUND OF THE INVENTION

A device for delivering printed products is known from DE 196 42 130 C2.

This device is comprised of a paddle wheel, into whose paddles or pockets printed products are inserted. A gripper chain, which is conducted around the rotary shaft of the paddle wheel, has a plurality of grippers for picking up a product inserted into a paddle of the paddle wheel, for clamping the product in place and, in the course of the progress of the rotation of the paddle wheel, for moving the product out of the paddle and conveying it on.

DE 196 42 118 C2 describes a device for transporting and distributing printed products. This device has a paddle wheel, in whose paddles the printed products to be transported and conveyed are introduced, and from which they are removed by grippers of a gripper chain. The gripper chain passes along a plurality of distribution points, at each of which distribution points cam disks are rotatably arranged which, in accordance with their rotary position, alternatingly act or do not act with the passing grippers in order to selectively unload a product held in a gripper at the appropriate distribution point, or to transport the product further.

The device described in DE 196 42 118 C2 is used, for example, for distributing folded printed products and for depositing them in layers. In the course of this printed product distribution and deposition, the need may arise for alternatingly depositing printed products arriving from two different product streams and coming from two different folding devices. With this known device, this desired product deposition is only possible if the printed products have already been inserted into the paddles of the paddle wheel in an alternating manner.

SUMMARY OF THE INVENTION

The object of the present invention is directed to providing a device for transferring printed products, as well as providing a machine and a method for processing printed products.

In accordance with the present invention, this object is attained by the provision of a first paddle wheel that receives printed products from a first product stream, and by the provision of a second paddle wheel that receives printed products from a second, separate product stream. A gripper chain, which carries product engaging grippers, is used to remove products from the first paddle wheel and to release them at a designated location. The same gripper chain also removes products from the second paddle wheel. Each paddle wheel is supported by its own shaft. The gripper chain passes around both of those shafts.

In the device in accordance with the present invention, the joining of the product streams takes place at the second paddle wheel, at which time and location the grippers of the gripper chain, which had remained empty during the passage of the gripper chain around the first paddle wheel, are now equipped or provided with products of the second product stream. Since the two paddle wheels can be placed substantially at any arbitrary locations along the path of travel of the gripper chain, there is no necessity to place conveyor belt arrangements, for delivering the two product streams, so closely together that they can introduce the products into the same paddle wheel. This elimination of such side constraints simplifies the construction of the device or of an apparatus with which it is employed. It also permits the optimization of the placement of its components, for example in view of modularity, in the use of as many uniform components as possible, for easy accessibility for maintenance purposes, and the like.

In the present device, the gripper chain transporting the product stream, combined in this way, preferably passes along at least two devices for opening the grippers, at least the first of which is configured to selectively open or to leave unopened a passing gripper. By the appropriate control of this device, the combined product streams can again be separated into their original single streams, and the single product streams can be separately deposited.

A device for opening the grippers, which device is rotatable with the movement of the gripper chain in particular can be used. Its speed of rotation is matched to the speed of the gripper chain in such a way that two successive cams of the cam disk alternatingly act together with grippers of the gripper chain which are separated by a gripper which does not act alternatingly for separating the product streams. In the case where the device has two paddle wheels for combining two product streams, the two alternatingly acting grippers are separated by exactly one non- interacting gripper. In the case of three or more product streams, which are respectively brought together by the use of an associated paddle wheel, the separation can also be two or more non-interacting grippers.

Furthermore, the cam disk can preferably be arrested, or stopped, in a position in which it alternatingly acts with each passing gripper, so that all of the grippers passing through the device are opened by the cam disk. The cam disk can have a position in which it does not alternatingly act with any of the passing grippers, so that all of the grippers are let through unopened to a downstream connected device for opening the grippers.

The device for delivering printed products in accordance with the present invention can be used, in particular, in a machine for processing printed products, which machine has at least two folding devices. Each of the paddle wheels of the device is arranged downstream of the respective folding apparatus for use in picking up a product stream delivered to it by the associated folding apparatus.

Since the paddle wheels can be arranged at substantially any arbitrary position along the gripper chain, the placement of the folding devices is subjected to only a few side constraints. This makes possible the use of completely identical folding devices or folding arrangements and thus accomplishes the reduction of the construction costs of the machine. It can also accomplish, among other things, the arrangement of the folding devices on top of each other in order to provide a machine having little space requirements, and in which both folding devices are easily accessible, in the same way, for maintenance purposes.

When operating the device for delivering printed products, in accordance with the present invention, or a machine with which it is used, preferably each second gripper of the gripper chain is provided, at the first paddle wheel, with a printed product of the first product stream. The grippers, which had not been loaded during the passage of the gripper chain device through the first paddle wheel, are each provided with a printed product from the second product stream at the second paddle wheel. The combined product stream now being transported by the gripper chain consists of a product of the originally first product stream and of a product of the originally second product stream with these products arranged in an alternating manner.

By rotating the cam disk, which is located at the first device for opening the grippers, in such a way that it alternatingly acts with each second gripper, the combined product stream is again separated into the two original streams at this device. Depending on the phase of the rotation of the cam disk, this can be the first or the second original product stream which is deposited at the first device.

If the cam disk is stopped in such a way that it alternatingly acts with each gripper, the printed products of the first and second product stream are alternatingly deposited at the first device. It is also conceivable to configure the cam disk to be movable between a first position, in which it can alternatingly act with the grippers of a gripper chain, and a retracted position. In the alternatingly acting position, it is then possible, depending on whether the cam disk rotates or not, to alternatingly deposit the first product stream or the second product stream, or to deposit only one of the product streams. In the retracted position, all of the product streams are permitted to pass to a further device for opening the grippers.

BRIEF DESCRIPTION OF THE DRAWINGS

A preferred embodiment of the present invention is represented in the drawings and will be described in greater detail in what follows.

DESCRIPTION OF THE PREFERRED EMBODIMENT

Figure 1:
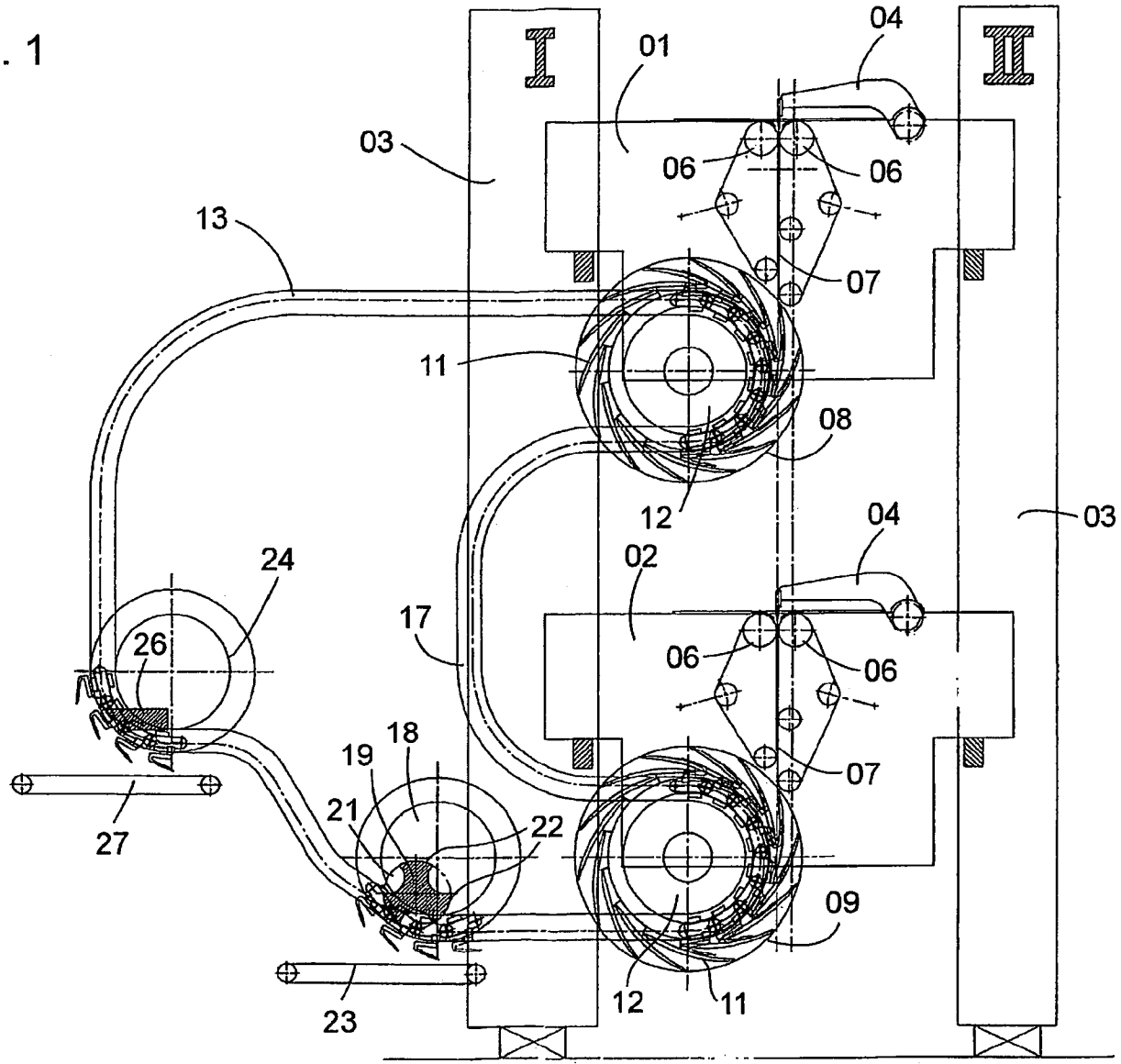
FIG. 1 is a schematic side elevation view of a paper-processing machine in accordance with the present invention

Referring initially to FIG. 1, there may be seen a side elevation view of a device for delivering printed products in accordance with the present invention,. The machine represented in FIG. 1 is comprised of an upper longitudinal folding device 01 and of a lower longitudinal folding device 02, which two folding devices 01, 02 have been placed on top of each other between supports 03 of a lateral frame. A pivotable folding blade 04 of each of the two longitudinal folding devices 01, 02 is used for introducing a respective presented signature between folding rollers 06 of the associated folding device and to form in this way, a longitudinal fold in each of the signatures. The now folded signatures are clamped between two facing endless belts of a belt guide device 07, which belt guide device 07 starts at the associated folding rollers 06. These signatures are then guided downward to one of an upper paddle wheel or a lower paddle wheel 08 or 09 and fall into their paddles or pockets 11. A ratio of a speed of rotation of the paddle wheels 08, 09 and a working frequency of the folding devices 01, 02 has been selected to be such that only every second paddle or pocket 11 of each of the first and second paddle wheels 08, 09 is provided a signature.

Figure 2:
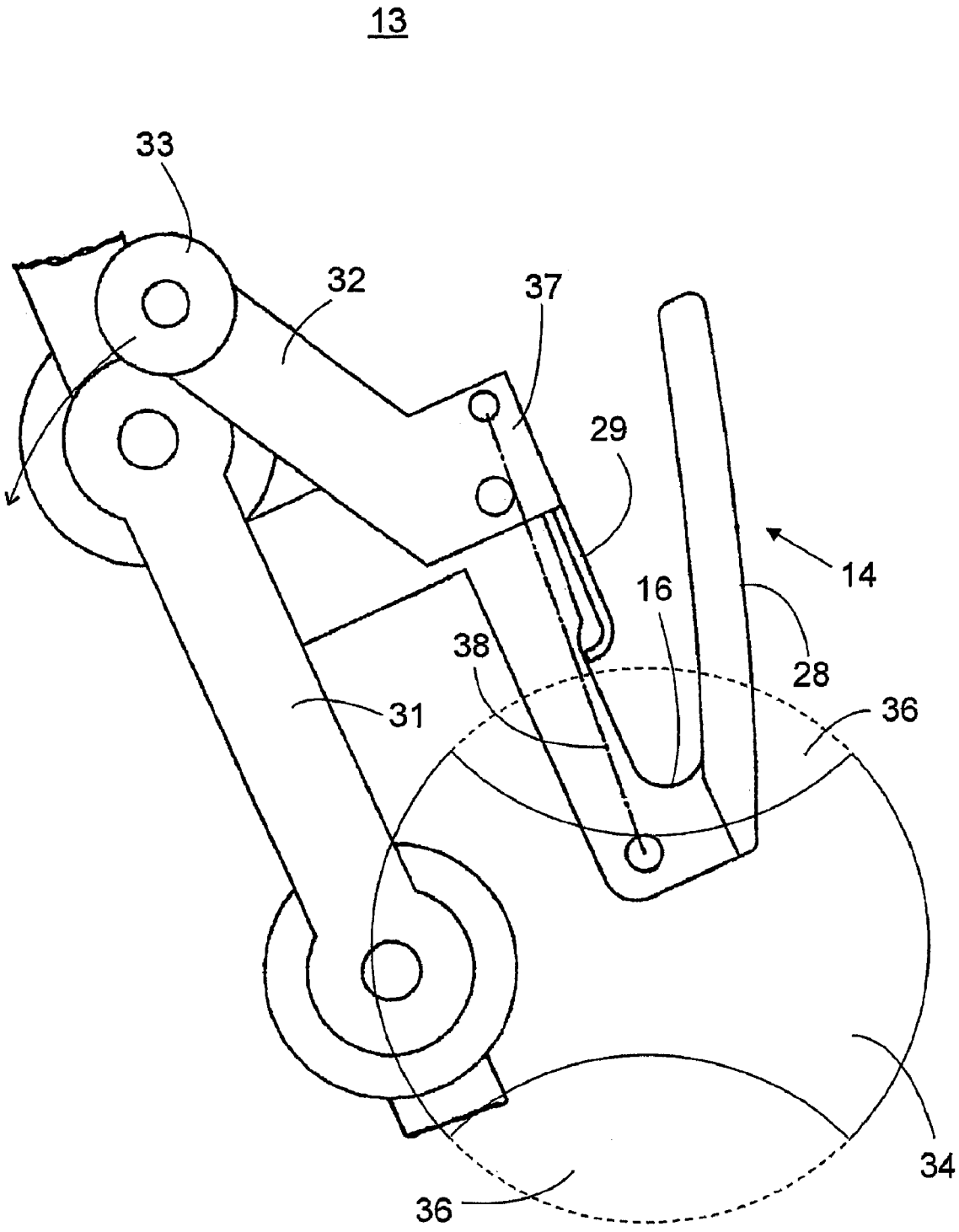
FIG. 2 is a schematic side elevation view of a gripper of the device shown in FIG. 1 in the open state.
Figure 3:
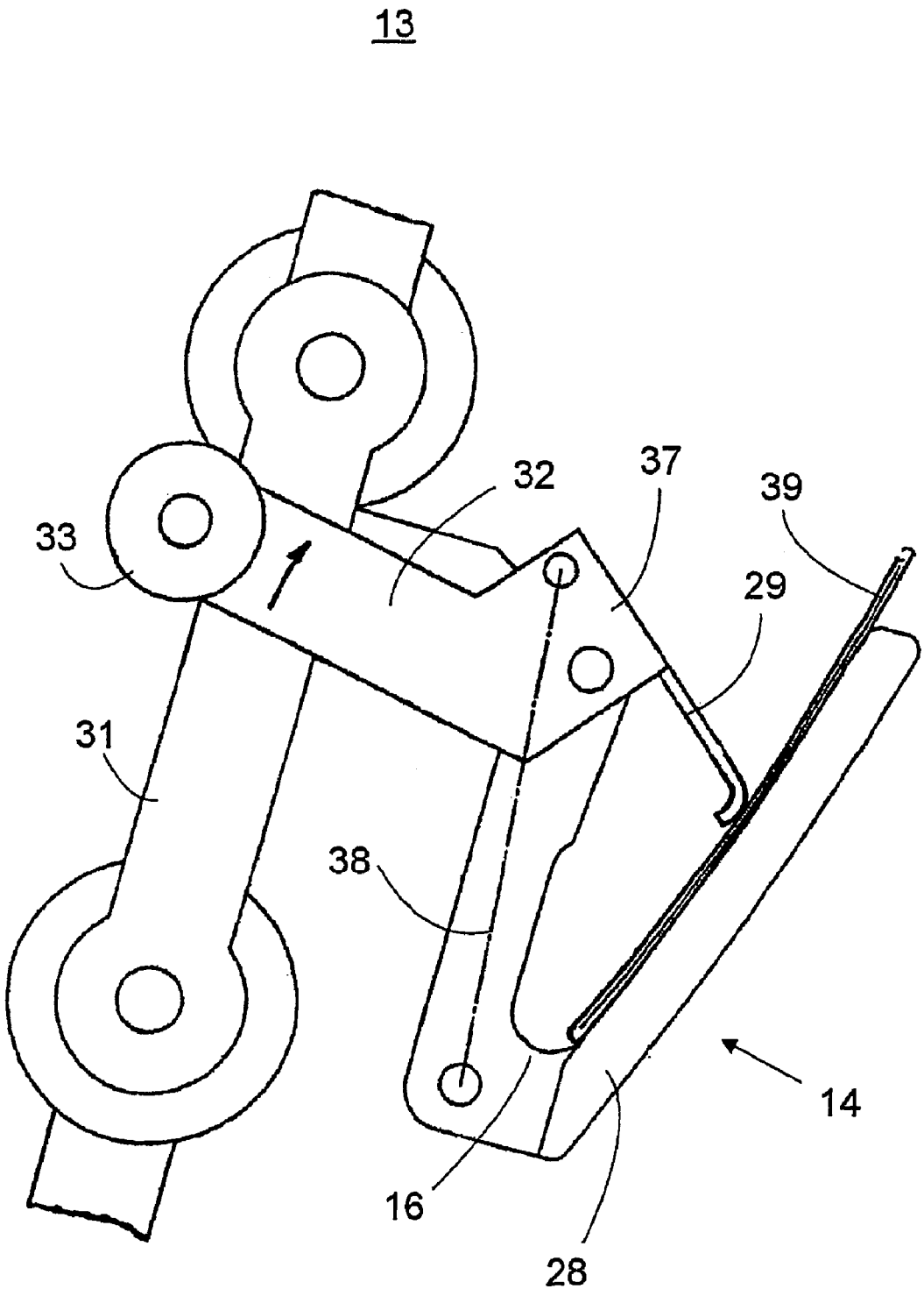
FIG. 3 is a schematic side elevation view of the gripper in the closed state with a product clamped in it.

The paddles or pockets 11 of each paddle wheel 08, 09 are made of at least two segments, which segments are spaced apart from each other in the axial direction of the paddle wheel 08, 09. Carrier wheels 12 are arranged in one space or in two spaces between the segments of the paddles or pockets 11. Around one half of the circumference of each carrier wheel 12 a gripper chain 13 is looped. The gripper chain 13 supports a multitude of grippers 14, one of which is shown in FIGS. 2 and 3. The structure and the function of the grippers 14 is the same as is described in the previously cited documents DE 196 42 118 and DE 196 42 130, to which reference is made here. The grippers 14 are described and are depicted by FIGS. 2 and 3 only to the extent required for an easy understanding of the present invention.

FIG. 2 shows a portion of the gripper chain 13 with a gripper 14 shortly before reaching the loading position at either one of a paddle wheel 08 or 09. The gripper 14 has a fixed clamping jaw 28 and a pivotable clamping jaw 29. In a side view, the fixed clamping jaw 28 is substantially V-shaped and is fixedly connected with a member 31, such as a link, of the gripper chain 13. The pivotable clamping jaw 28 is embodied as a first arm of a three-armed lever. A second arm of this three arm lever is embodied as a control lever 32 and supports a roller 33. To effect the closing of the movable clamping jaw 29, following the insertion of the signature, the control lever 32 can be actuated by the provision of a control cam 34, which control cam 34 rotates, together with the paddle wheel 08 or 09, around a shaft that is fixed on the frame. The rotation of the control cam 34 is coupled to the movement of the gripper chain 13 in such a way that, of two successive grippers 14, the one of the grippers 14 which does not take up a signature passes the control cam 34 with its roller 33 engaging one of the control cam cutouts 36, and therefore this gripper 14 remains open, while the gripper 14 receiving a signature has with] its roller 33 roll against the surface of the control cam 34.

In place of the rotating control cam 34, a stationary control cam can also be arranged for use on the lower paddle wheel 09. This stationary control cam closes each one of the grippers 14 passing it.

A third arm of the three-armed lever is embodied as a spring-loaded clamping lever 37, on which an extension spring 38 acts. When, in the course of the bumping or the contacting of the roller 33 against the control cam 34, the lever begins to pivot, the extension spring 38 is initially stretched so far as to reach a dead center. After passing dead center, the extension spring 38 pulls the three-armed lever into its clamping position, as shown in FIG. 3, and in this way holds the inserted signature 39 between the clamping jaws 28, 29.

Now referring again to FIG. 1, the diameter of the carrier wheel 12 has been selected such that the crowns or apexes 16 of the hook-shaped grippers 14 each coincide with the bottom of a paddle 11. The linear spacing distance between successive ones of the grippers 14 along the gripper chain 13 corresponds to the distance between the bottoms of successive paddles 11 of either of the paddle wheels 08 or 09. The carrier wheel 12 rotates in a fixed connection with its associated paddle wheel 09, so that the track speed of the grippers 14 is the same as that of the bottoms of the paddles In an alternative configuration, the linear spacing distance between the grippers 14 along the gripper chain 13 can also be greater by a factor "a" than the distance between the paddle bottoms, and the track speed of the paddle bottoms is greater, by this factor "a," than the speed of the gripper chain 13. In this case, the movement of the gripper chain 13 is coordinated with the rotation of the paddle wheels 08, 09 in such a way that the respective bottom of the paddle 11 located at the outlet of the conveyor belt arrangement 07 overlaps the crown 16 of a gripper 14. A product, which is inserted by the conveyor belt arrangement 07 into the paddle 11, is supported, on the one hand, at the bottom of the paddle 11 and, on the other hand, enters deeply enough into the gripper 14 so that it can be clamped in place there.

The two paddle wheels 08, 09 are connected by a generally C-shaping segment 17 of the gripper chain 13. This type and shape of guidance of the gripper chain 13 allows the arrangement of the paddle wheels 08, 09 and the folding devices 01, 02 supplying them vertically above each other. A portion of the lower folding device 02 is positioned in the bulge defined by the C-shaped segment 17 of the path of travel of the gripper chain 13.

The operation of the upper and lower longitudinal folding devices 01, 02 is synchronized in such a way that, at the upper paddle wheel 08, every second gripper 14 of the gripper chain 13 is provided with a signature that was folded in the upper folding device 01. The grippers 14 which remain empty are subsequently provided, at the lower paddle wheel 09, with signatures folded in the lower folding device 02. When leaving the lower paddle wheel 09, the grippers 14 alternately each carry a signature from either the upper folding device 01 or from the lower folding device 02.

Downstream of the lower paddle wheel 09, in the direction of travel of the gripper chain 13, the gripper chain 13 passes through a first arrangement for opening the grippers 14, which first opening arrangement is embodied in the manner of a first ejector 18. This first ejector 18 comprises a rotatable cam disk 19, which has three cam surfaces 22, which are each separated by cutouts 21. The cam disk 19, which is coupled to the movement of the gripper chain 13, is rotatable in such a way that of two grippers 14 passing the cam disk 19, a first one interacts with a cam 22 and is therefore opened, while the roller 33 of a second one of the two grippers 14 engages a cutout 21 of the cam disk 19, so that the second gripper 14 passes the first ejector 18 without being opened.

In this way, every second signature conveyed by the gripper chain 13 is delivered, at the first ejector 18, to a first conveyor belt arrangement 23 extending underneath the first ejector 18. Depending on the phase position of the cam disk 19, the delivered signatures can be those which were inserted in the upper paddle wheel 08 or which were inserted in the lower paddle wheel 09.

Following the first ejector 18, a second ejector 24 has been placed along the track of the gripper chain 13 and has a stationary cam 26. That stationary cam 26 interacts at least with the rollers 33 of the grippers 14 which had not been opened at the first ejector 18 all of the signatures reaching the second ejector 24 are there delivered to a second conveyor belt arrangement 27.

In this way it is possible, by the operation of the machine represented in FIG. 1, to simultaneously fold two streams of signatures and to deliver them separated from each other.

If the cam disk 19 of the first ejector 18 is arrested in a position in which one of its cams 22 interacts with all of the passing grippers 14 for opening them, a stream is delivered to the first conveyor belt arrangement 23, in which signatures folded at the folding devices 01, 02 alternate with each other.

As an alternative to arresting the cam disk 19, or also in addition thereto, the option can be provided of moving the cam disk 19 away from the gripper chain 13, so that it no longer interacts with any of the passing grippers 14. In this case, the entire stream of signatures reaches the second ejector 24 and is delivered there.

The machine of the present invention can, of course, also be employed for folding a single product stream. Only one of the two folding devices 01, 02 is in operation.

It is obvious that the above described machine concept can easily be generally applied in connection with devices in which "n">2 paddle wheels are provided for joining "n" product streams. A rotatable control cam, analogous to the one represented in FIG. 2, is assigned to the "n"−1 first paddle wheels, wherein the width of the cutouts in the control cam has been selected in such a way that, with a uniform rotation of the control cam, only one of "n" successive grippers meets the protrusion of the control cam and is closed. To these "n" paddle wheels, "m" ejectors have been assigned, wherein "m" preferably equals "n," in order to deliver each of the individual product streams separately. Of these "m" ejectors, at least the "m"−1 first ones have a cam disk for the selective opening of the grippers respectively loaded with products of an identical inflow. With such a cam disk, the proportion of cams on the total circumference of the cam disk has been selected in such a way that only one of "m" grippers 14 successively passing the ejector is opened.

While a preferred embodiment of a device for delivering printed products and a machine and method for processing printed products, in accordance with the present invention, has been set forth fully and completely hereinabove, it will be apparent to one of skill in the art that various changes in, for example, the drives for the gripper chains, the specific folding devices used, and the like could be made without departing from the true spirit and scope of the present invention which is accordingly to be limited only by the appended claims.

What is claimed is:

1. A device for delivering printed products comprising:

a first paddle wheel supported for rotation about a first shaft and having a plurality of first paddles for receiving printed products from a first product stream;

a second paddle wheel supported for rotation about a second shaft and having a plurality of second paddles for receiving printed products from a second product stream;

a gripper chain, said gripper chain being conducted around said first shaft and said second shaft;

a plurality of grippers on said gripper chain, said grippers each being operable to remove a printed product from at least one of said first and second paddles; and at least a first gripper opening assembly passed by said gripper chain and which is positioned to open at least selected ones of each plurality of grippers.

2. The device of claim 1 further including at least a second gripper opening assembly passed by said gripper chain.

3. The device of claim 2 wherein said first gripper opening assembly includes a rotatable cam disk that is rotatable in concert with movement of said gripper chain, said rotatable cam disk having at least two spaced cams, said two spaced cams cooperating with selected ones of said grippers which are separated by a gripper not cooperating with said rotatable cam disk.

4. The device of claim 3 further including means for stopping rotation of said cam disk whereby said cam disk interacts with each one of said plurality of grippers.

5. The device of claim 3 further including means for stopping rotation of said cam disk whereby said cam disk interacts with none of said plurality of passing grippers.

6. The device of claim 1 wherein said second gripper opening assembly includes a stationary cam adapted to opening each one of said plurality of grippers.

7. The device of claim 1 further including a first printed product conveying device associated with said at least first gripper opening assembly.

8. The device of claim 2 further including a first printed product conveying device associated with said first gripper opening assembly, and a second printed product conveying device associated with said second gripper opening assembly.

9. The device of claim 1 further including a first folding device adapted to provide printed products to said first paddle wheel and a second folding device adapted to provide printed products to said second paddle wheel.

10. The device of claim 9 wherein said first and second folding devices each have the same structure.

11. The device of claim 9 wherein said first and said second folding devices are arranged on top of each other.

12. The device of claim 1 wherein said gripper chain extends in a C-shaped path between each first paddle wheel and said second paddle wheel.

13. A method for processing printed products including:

providing a first paddle wheel;

directing a first stream of printed products to said first paddle wheel;

providing a second paddle wheel;

directing a second stream of printed products to said second paddle wheel;

providing a gripper chain having a plurality of printed product receiving grippers;

passing said gripper chain and said grippers past said first paddle wheel and supplying printed products from said first paddle wheel to at least selected ones of said plurality of grippers;

passing said gripper chain and said grippers past said second paddle wheel; and supplying any of said grippers not provided with printed product at said first paddle wheel with printed products at said second paddle wheel.

14. The method of claim 13 further including providing at least a first gripper opening assembly having a rotatable cam disk adapted to open selected ones of said plurality of grippers, and rotating said cam disk for selectively delivering printed products from one of said first and second streams of printed products at said first gripper opening device.

15. The method of claim 13 further including providing at least a first gripper opening arrangement having a cam disk adapted to open every one of said plurality of grippers passing said at least first gripper opening arrangement to alternatingly deliver said first and second product streams at said first gripper opening arrangement.

* * * * *